US005527249A

United States Patent [19]

Harris

[11] Patent Number: 5,527,249

[45] Date of Patent: Jun. 18, 1996

[54] MULTI-FUNCTION EXERCISE MACHINE MAKING USE OF BODY WEIGHT

[76] Inventor: Robert W. Harris, 3118 Stanford Dr., Durham, N.C. 27707

[21] Appl. No.: 500,802

[22] Filed: Jul. 11, 1995

[51] Int. Cl.[6] ..... A63B 21/00

[52] U.S. Cl. ..... 482/96; 482/95; 482/57; 482/72

[58] Field of Search ..... 482/96, 95, 72, 482/57, 106, 110, 111, 148, 51; 472/106, 110

[56] References Cited

U.S. PATENT DOCUMENTS

| | | | |
|---|---|---|---|
| 231,869 | 8/1880 | Tuttle | 482/95 |
| 2,252,156 | 8/1941 | Bell | 482/79 |
| 2,455,548 | 12/1948 | Bell . | |
| 2,642,288 | 6/1953 | Bell . | |
| 2,924,456 | 2/1960 | Miller | 482/57 |
| 4,300,760 | 11/1981 | Bobroff . | |
| 4,949,958 | 8/1990 | Richey | 482/130 |
| 5,277,684 | 1/1994 | Harris . | |
| 5,330,405 | 7/1994 | Habing et al. . | |
| 5,346,447 | 9/1994 | Stearns | 482/96 |
| 5,352,171 | 10/1994 | Lin . | |
| 5,421,795 | 6/1995 | Chen | 482/96 |
| 5,470,295 | 11/1995 | Wang | 482/96 |

*Primary Examiner*—Jerome Donnelly
*Attorney, Agent, or Firm*—Richard E. Jenkins

[57] ABSTRACT

A multi-function exercise machine which makes use of the body weight of an exerciser and has a base frame and a user support frame pivotably mounted thereon. A lever arm mechanism for pivotably raising and lowering the user support frame against the user's weight is provided and comprises a handle bar having a lever arm depending therefrom and carrying a roller on the lower end thereof. An arcuate track is adjustably mounted to the base frame so as to provide an adjustable arcuate pathway for the lever arm roller to travel upon as the user pivotably motivates the handle bars and lever arm secured thereto in order to raise and lower the user support frame. Pushing and pulling exercises may be performed according to the selected position of the arcuate track.

20 Claims, 4 Drawing Sheets

MULTI-FUNCTION EXERCISE MACHINE MAKING USE OF BODY WEIGHT

TECHNICAL FIELD

The present invention relates generally to an exercise machine, and more particularly to a multi-function exercise machine which makes use of the body weight of the user as the load weight of the machine.

RELATED ART

In recent years the value of staying trim and fit through the use of exercise machines has become well recognized. This desire by both men and women for physical fitness has resulted in the availability of membership health clubs that provide a variety of exercise machines upon which to perform one or two specific exercises to exercise certain specific muscles.

In view of the popularity of the exercise machines provided at membership health clubs, more recently a wide variety of exercise machines have been marketed for home use. However, due to the cost and space limitations, home exercise machines by necessity are generally multi-purpose singular unit exercise machines. Moreover, many of the conventional multi-purpose exercise machines designed for home use have suffered from shortcomings with respect to size, cost and/or complexity so as to limit their appeal to the average person. More specifically, many of the conventional home use exercise machines are provided with various weights which are lifted by means of cables and pulleys for the purpose of building the body of the user of the exercise machine. Unfortunately, this type of home exercise machine leaves much to be desired because of high cost, large size, and lack of portability.

Therefore, home exercise machines have now become available that make use of the body weight of an exerciser as a load weight in place of conventional dead weights. This type of home exercise machine is highly desirable since it utilizes user body weight for at least part of the total resistance and thus is relatively lightweight and easy for the user to move.

Quite a number of home exercise machines are known which make use of body weight as at least a part of the load weight of the machine. Of particular relevance to the present invention are exercise machines that raise and lower the user during exercise by means of a rolling and/or rotating lever arm mechanism. This type of machine normally employs a handle and/or pedal mechanism connected to a lever arm, and the lever arm is rotatably mounted beneath a movable seat such that a wheel at the bottom thereof rolls along a generally horizontal track when the handles are pulled and the pedals are pushed. Generally, as the lever arm under the seat pivots its angle becomes more vertical and thereby forces the seat and user upward. U.S. Pat. No. 4,300,760 to Bobroff discloses an exercise device utilizing this type of mechanism.

Also, U.S. Pat. Nos. 2,642,288 and 2,455,548 to Bell disclose exercise machines with pivotably movable lever arms with a wheel at the end thereof which rolls along an irregularly-shaped inclined track whose angle can be adjusted in order to change the resistance encountered by the user during exercise.

However, applicant believes that there is a long-felt need for a better exercise machine making use of body weight and particularly adapted for home use that provides multiple functions not to be found in prior art machines. Specifically, applicant has developed a multi-function exercise machine making use of body weight that provides relatively uniform resistance to movement; provides for both pushing and pulling exercises; and provides adjustability to the resistance in both the pushing and pulling exercises that can be performed on the exercise machine.

DISCLOSURE OF THE INVENTION

In accordance with the present invention, applicant provides a multi-function exercise machine which makes use of the body weight of an exerciser as the load weight of the machine. The apparatus comprises a base frame including upwardly extending support means, and a user support frame (including a user seat) pivotably mounted to the upwardly extending support means of the base frame. Lever arm means are provided for pivotably raising and lowering the user support frame against the user's weight and comprise: a pair of spaced-apart and upwardly extending support arms secured to the base frame; a pair of spaced-apart pivot rods each mounted to the base frame in the space defined between the spaced-apart support arms and adjacent the juncture of a corresponding support arm with the base frame; an arcuate track adapted to be removably secured at one end to a selected one of the pair of pivot rods and at the other end to be adjustably secured to a selected distal one of the pair of support arms in order to define an inclined pathway; and a lever arm pivotably mounted to the user support frame including a handle extending above the user seat and having a downwardly depending leg carrying a roller at the lowermost end thereof that is adapted to travel along the length of the arcuate track as the handle is actuated so as to raise and lower the user seat during reciprocating actuating movement of the handle by the user.

It is therefore the object of the present invention to provide an improved multi-function exercise machine which makes use of the body weight of an exerciser and provides a wide variety of standard weightlifting exercises using an adjustable portion of the user's body weight as the resistance.

It is another object of the present invention to provide a multi-function exercise machine which makes use of the body weight of the user to provide a relatively uniform resistance throughout the concentric and eccentric phases of exercises.

It is another object of the present invention to provide a multi-function exercise machine which makes use of the body weight of the user and allows the handle bar/lever arm to be pivoted either forward or rearward against resistance so as to provide both push and pull exercises. It is still another object of the present invention to provide a multi-function exercise machine which makes use of the body weight of the user and is adapted such that a single removable pin may be utilized to adjust both the resistance level to movement and the direction of movement against resistance of the handle bar/lever arm.

It is yet another object of the present invention to provide a multi-function exercise machine which makes use of the body weight of the user and that further allows the user's base body weight to be augmented with selected lightweight elastic bands as a matter of user choice.

Some of the objects of the invention having been stated, other objects will become evident as the description proceeds, when taken in connection with the accompanying drawings described hereinbelow.

BEST MODE FOR CARRYING OUT THE INVENTION

Figure 1:
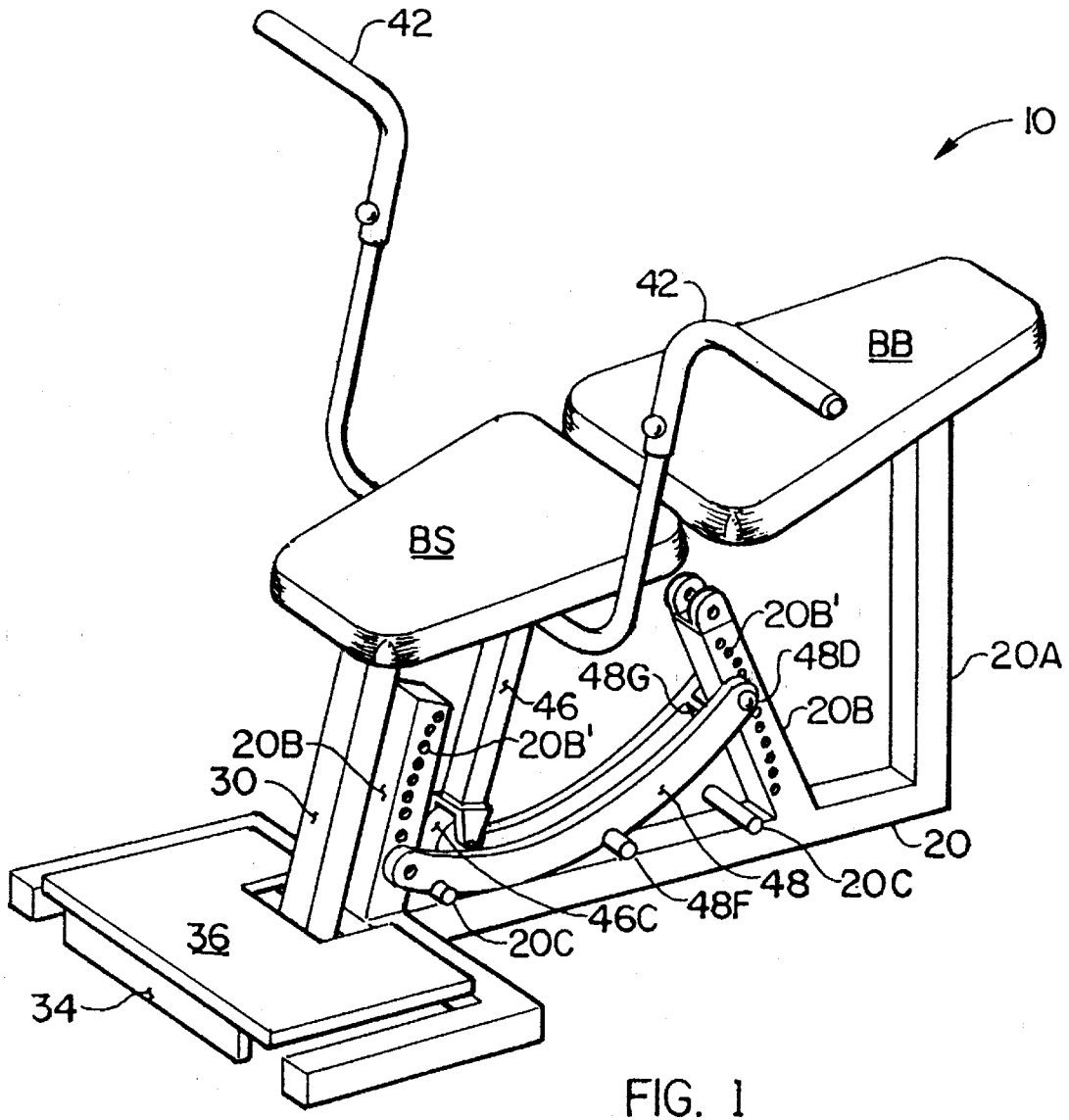
FIG. 1 is a perspective view of a multi-function exercise machine embodying the present invention.
Figure 2:
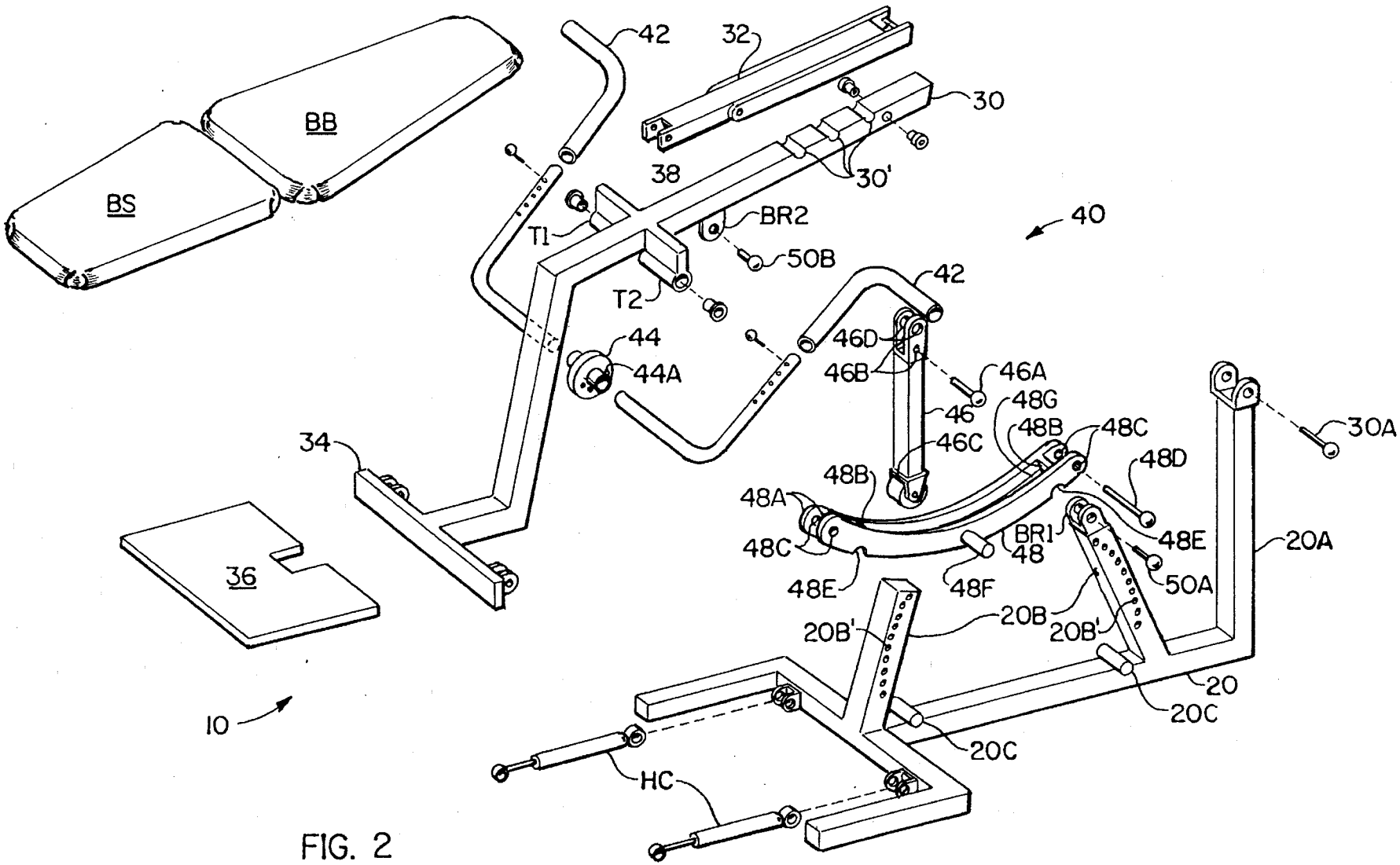
FIG. 2 is an exploded perspective view of the exercise machine.
Figure 3B:
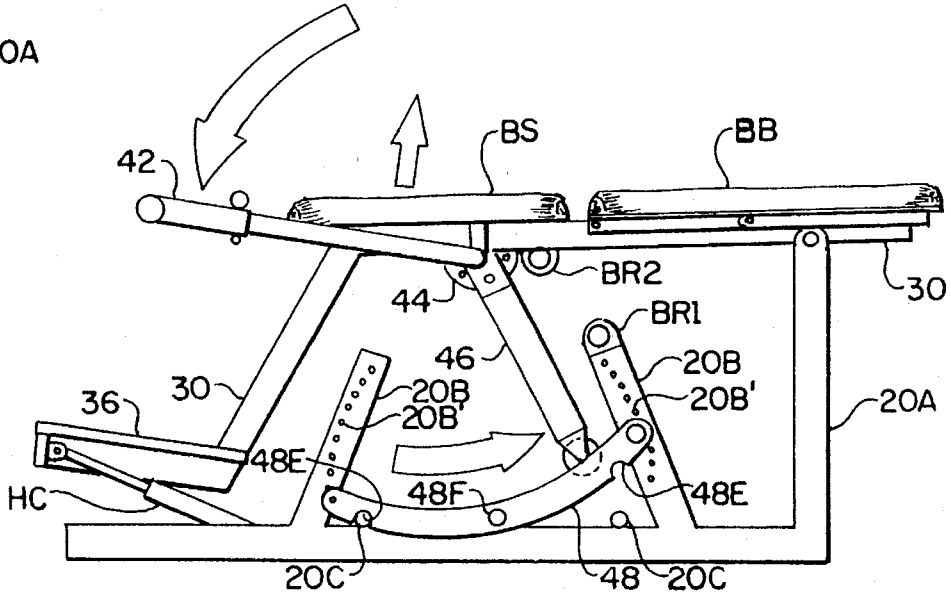
FIG. 3B is a side elevation view of the exercise machine with the lever arm having been pushed to its forwardmost position so as to raise the user support frame and seat upwardly.
Figure 3A:
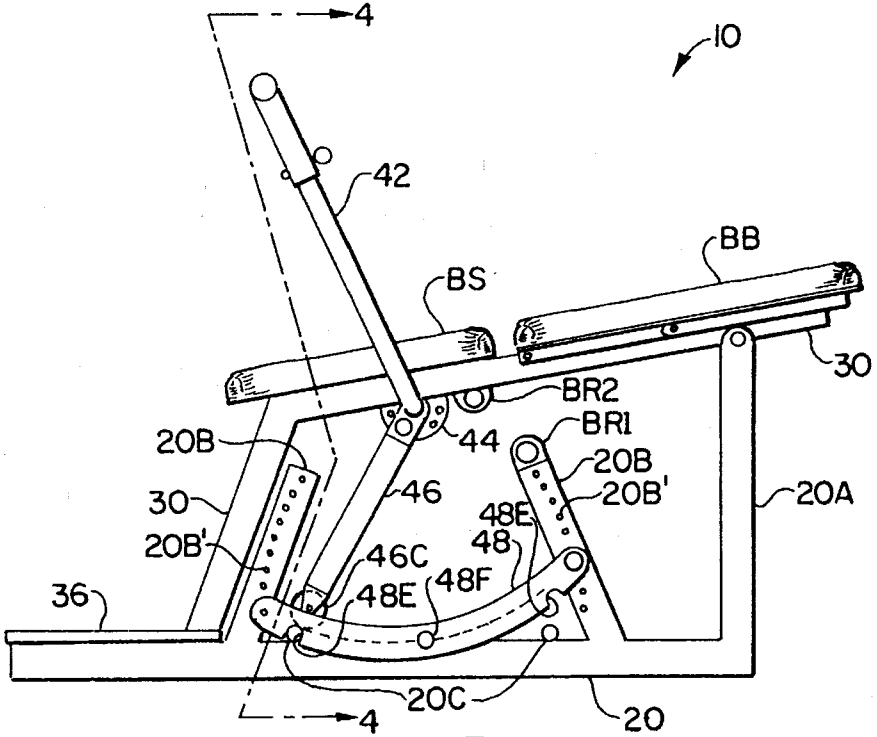
FIG. 3A is a side elevation view of the exercise machine with the lever arm in one of two rest positions in its inoperative mode.
Figure 4:
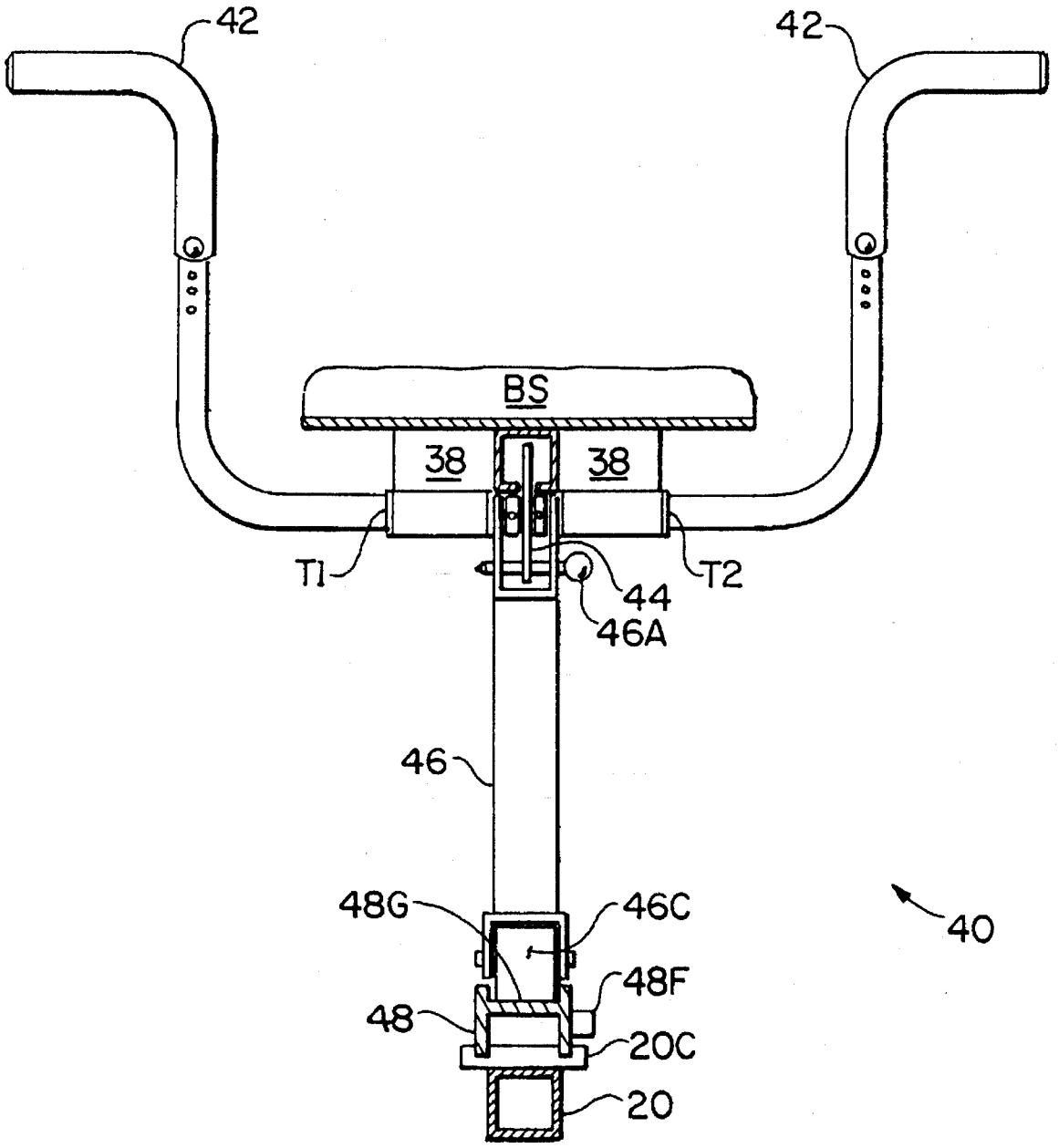
FIG. 4 is a vertical cross-sectional view taken along the lines 4—4 of FIG. 3A illustrating the lever arm mechanism of the exercise machine.

Referring now to FIGS. 1–4 of the drawings, the multi-function exercise machine which makes use of the body weight of an exerciser is shown and generally designated by the numeral 10. Apparatus 10 comprises a base frame 20 comprising a longitudinal rear frame element and a U-shaped front frame element which will be described in more detail hereinafter. Base frame 20 includes an upwardly extending rear post 20A that defines a bracket at the top end thereof that supports the rear of the user support frame to be described hereinafter.

A pair of inwardly inclined and upwardly extending posts 20B are provided on base frame 20 to support a lever arm track to be described hereinafter. Each of posts 20B include a plurality of holes 20B' therethrough arranged in a circular arc. A pivot rod 20C is positioned adjacent the inside face of each post 20B and spaced-apart therefrom about 1–3 inches. Pivot rods 20C comprise metal rods mounted transversely to the rear frame element of base frame 20, and each pivot rod 20C is located at the center of the arc formed by holes 20B' in the distally spaced post 20B. The lever arm track to be defined hereinafter is mounted at one end to a respective one of pivot rods 20C and secured at its opposing end to a corresponding one of the pair of posts 20B in a manner which will also be described hereinafter.

Apparatus 10 further comprises user support frame 30 including bench seat BS and bench back BB wherein bench back BB is pivotably supported by back support arm 32 which is pivotably mounted to user support frame 30. User support frame 30 is pivotably mounted at the rear end thereof to rear post 20A by means of a suitable locking pin 30A. User support frame 30 defines a downwardly depending portion at the front end thereof which terminates in cross member 34 that acts to engage the outermost ends of a pair of hydraulic cylinders HC which are in turn secured at the innermost ends thereof to the crossbar of the front U-shaped portion of base frame 20 in a conventional fashion (see FIG. 2). Foot platform 36 is suitably secured to the front portion of user support frame 30 immediately above hydraulic cylinders HC. Hydraulic cylinders HC act to stabilize the front end of exercise apparatus 10 and to control the return of user support frame 30 (and bench seat BS and bench back BB) to the rest position (see FIG. 3A) after being raised (see FIG. 3B). It will be appreciated that user support frame 30 is supported at the front end by the floor surface upon which exercise apparatus 10 rests when in the at-rest position.

As previously described, bench seat BS is fixedly mounted to user support frame 30, and back bench BB is pivotably mounted to user support frame 30 by back support arm 32 to allow it to be adjusted to provide the most suitable back support to a user in sitting position on exercise apparatus 10. Platform 36 attached to the front end of user support frame 30 is intended to be a footrest, but platform 36 can also function to allow the user to stand or kneel thereon to accomplish certain exercises.

Between base frame 20 and pivotably mounted user support frame 30 there is provided a lever arm mechanism generally designated 40 that allows the user to pivotably raise user support frame 30 (and bench seat BS and bench back BB) upwardly against the user's weight. Lever arm mechanism 40 comprises two handle bar elements 42 which are inserted through tubes T1 and T2 (see FIG. 4) and through holes 46D of lever arm 46, and then affixed together by set screws to disk 44. Disk 44 defines a plurality of holes 44A around the bottom portion of the circumference thereof. Selector plate or disk 44 and handle bars 42 form a rigid unit which can be adjustably secured to lever arm 46 by means of locking pin 46A which is adapted to extend through a pair of holes 46B in lever arm 46 and through a selected one of the plurality of holes 44A in disk 44 in order to form a locking engagement therebetween. This can best be seen in FIG. 2 and FIG. 4 of the drawings. Thus, handle bars 42 are fixedly mounted to disk 44 and can be adjustably secured to lever arm 46 by means of removable locking pin 46A so as to define a desired angle therebetween. The lower end of lever arm 46 carries a suitable roller 46C thereon so as to roll along the arcuate length of the roller surface 48G of track 48.

Referring again to FIG. 4, it will be appreciated that handle bars 42 are rotatably mounted within the two spaced-apart horizontal tubes T1, T2 defined within the bottom portions of transverse seat support arms 38 of user support frame 30. Seat support arms 38 also define a space in the medial portion thereof to allow disk 44 to be received therein so that the bottom of disk 44 is positioned within the upper portion of lever arm 46 and secured thereto by locking pin 46A. As will be recalled, locking pin 46A is inserted through holes 46B in lever arm 46 and through a selected one of the plurality of holes 44A in disk 44 in order to fixedly secure lever arm 46 to handle bars 42 at a desired angle.

Track 48 of lever arm mechanism 40 forms an arcuate path along which lever arm wheel 46C rolls when handle bars 42 are pushed and/or pulled. Track 48 is suitably formed by two parallel vertical side plates 48A which are suitably joined together along the length thereof by transverse webs 48B and roller surface 48G. Track 48 controls and defines the movement of lever arm 46 so that when lever arm 46 is pivoted during the concentric phase of an exercise it will roll along track 48 in an upward path. The arcuate shape of track 48 is fashioned to cause the resistance encountered by the user to be substantially uniform throughout the concentric and eccentric phases of an exercise.

Track 48 includes a pair of holes 48C at each end thereof so that locking pin 48D may be used to selectively secure one end of track 48 to a selected one of the plurality of holes 20B' in a corresponding post 20B. The other end of track 48 will rest on distal pivot rod 20C by means of one of the two pairs of notches 48E located in the bottom surface adjacent each end of track 48. Thus, during an exercise, one of the pair of notches 48E will be placed into contact with its corresponding pivot rod 20C and the other end of track 48 will be secured to a desired hole 20B' in a corresponding upright post 20B with locking pin 48D. In this fashion, during an exercise track 48 is always supported at one end on a pivot rod 20C and at the other is secured by locking pin 48D to one of posts 20B.

Very importantly, to change the direction of movement of handle bars 42 and connected lever arm 46, the user removes locking pin 48D, temporarily supports track 48 on both pivot rods 20C, and then the end of track 48 that previously rested on one of pivot rods 20C is secured to post 20B adjacent the previous pivot rod 20C with locking pin 48D and the other end of track 48 remains secured to the other distal pivot rod 20C.

In use, the user of exercise apparatus 10 would make the following adjustments in accordance with his needs:

1. To change only the resistance afforded by movement of handle bars 42, the user would remove locking pin 48D, use track handle 48F to raise or lower the free end of support track 48 with the opposite pivot rod 20C as the pivot axis, and reinsert locking pin 48D. During this adjustment, the rest position of lever arm 46 does not change.
2. To change the rest position of lever arm 46, the user would remove locking pin 48D, lower the free end of track 48 so that the track is supported on both pivot rods 20C, and then rotate lever arm 46 to the opposite rest position. The user would then adjust the resistance provided to movement of handle bars 42 as described in paragraph 1 above.
3. To change the initial position of handle bars 42, the user would pull locking pin 46A that connects handle bars 42 to lever arm 46, rotate handle bars 42 to the desired position, and then reinsert locking pin 46A.
4. To change the angle of bench back BB, the user would pivot back support arm 32 to the desired location determined by detentes 30' in user support frame 30.

An optional feature of exercise apparatus 10 is provided by bracket BR1 at the top of rearwardly located post 20B and bracket BR2 located beneath user support frame 30. If additional resistance is desired greater than the user's base weight, the user can secure one or more rubber bands or straps between brackets BR1 and BR2 by means of removable pins 50A and 50B, respectively. The addition of the rubber bands or straps (not shown) will serve to augment the user's base weight resistance, but it is not intended to be used to adjust the resistance level per se (which is accomplished by adjusting the raised end of track 48 along the arc of holes 20B' within corresponding post 20B). Once Apparatus 10 has been set up for exercise (which should take no more than 10–20 seconds), apparatus 10 will allow the user to accomplish a large number of different exercises, including the following:

EXERCISE

Chest:

Bench Press, decline bench press, push down, assisted dips, straight-arm raise, one-arm butterfly.

Arms:

Biceps curl, triceps push down, triceps press, forearm curl, reverse forearm curl.

Shoulders and Neck:

Rear deltoid raise, front deltoid raise, shrugs, upright rowing.

Legs:

Rear extension, leg raise, hamstring curl, abduction, adduction, calf raise, hack squat, hip extension.

Back:

Dead lift, hyperextension, seated rowing, bent-over rowing, good morning stretch, side lateral adduction.

Abdominal:

Resisted sit up, abdominal crunch, Roman chair,, knee in, side bend.

Bench seat BS and bench back BB may also be used independently of handle bars 42 to permit exercises with free weights if the user so desires.

It will be understood that various details of the invention may be changed without departing from the scope of the invention. Furthermore, the foregoing description is for the purpose of illustration only, and not for the purpose of limitation—the invention being defined by the claims.

What is claimed is:

1. An exercise machine comprising:

(a) a base frame including upwardly extending support means;

(b) a user support frame, including a user seat, pivotably mounted to said upwardly extending support means; and (c) lever arm means for pivotably raising and lowering said user support frame against the user's weight and comprising:

(1) A pair of spaced-apart and upwardly extending support arms secured to said base frame, each of said arms including aperture adjustment means therein which extend upwardly along a length thereof defining an arcuate path therein;

(2) a pair of spaced-apart pivot rods each mounted to said base frame in a space defined between said spaced-apart arms and adjacent the juncture of a corresponding support arm with said base frame;

(3) an arcuate track, having first and second ends, adapted to be removably secured at one end to a selected one of said pair of pivot rods and at the second end adjustably secured to said aperture adjustment means, which is located in said selected distal one of said pair of support arms, for allowing said second end of said arcuate track to be selectively vertically adjusted along the length of said aperture adjustment means of said distal support arm, thereby providing a variably inclined path way;

(4) a lever arm pivotably mounted to said user support frame, including a handle extending above said user seat and further including a downwardly depending leg carrying a roller at the lowermost end thereof adapted to travel along the length of said arcuate track as said handle is actuated thereby raising and lowering said user's seat upon reciprocating actuating movement of said handle by the user.

2. An exercise machine according to claim 1 wherein said base frame comprises an elongated frame having a front end and a rear end and said upwardly extending support means is located at the rear end thereof.

3. An exercise machine according to claim 2 wherein said upwardly extending support means comprises a post member.

4. An exercise machine according to claim 1 wherein said user support frame extends generally horizontally and includes a pivotably mounted back support adapted to be used in both a lowered and a raised position.

5. An exercise machine according to claim 4 wherein said user support frame is elongated shaped with a front end and a rear end.

6. An exercise machine according to claim 5 wherein said user support frame further includes a downwardly depending foot rest platform at the front end thereof.

7. An exercise machine according to claim 1 wherein said aperture adjustment means of said pair of upwardly extending support arms each comprise a plurality of apertures therein along the length thereof.

8. An exercise machine according to claim 7 wherein said plurality of apertures in each of said support arms defines an arc having a radius extending to a corresponding and distal one of said pivot rods.

9. An exercise machine according to claim 1 wherein said pivot rods each comprises a rod extending transversely to the longitudinal axis of said base frame and spaced-apart from its corresponding support arm toward said opposing support arm about 1–3 inches.

10. An exercise machine according to claim 1 wherein said arcuate track includes a pair of notches in the bottom surface adjacent each end thereof for engaging a corresponding one of said pair of pivot rods therein, and said arcuate track further includes an aperture in each end thereof for securement to a corresponding one of said pair of upwardly extending support arms.

11. An exercise machine according to claim 1 wherein said lever arm provides means for adjusting the angle defined between said handle of said lever arm and said downwardly depending roller carrying leg.

12. An exercise machine comprising:

(a) a base frame having a front end and a rear end and including upwardly extending support means at the rear end thereof;

(b) a user support frame having a front end and a rear end and including a user seat, said user support frame being pivotably mounted to said upwardly extending support means of said base frame at the rear end thereof; and (c) lever arm means for pivotably raising and lowering said user support frame against the user's weight and comprising:

(1) A pair of spaced-apart and upwardly extending support arms secured to said base frame, each of said arms including aperture adjustment means therein which extend upwardly along a length thereof defining an arcuate path therein;

(2) a pair of spaced-apart pivot rods each mounted to said base frame in a space defined between said spaced-apart arms and adjacent the juncture of a corresponding support arm with said base frame;

(3) an arcuate track, having first and second ends, adapted to be removably secured at one end to a selected one of said pair of pivot rods and at the second end adjustably secured to said aperture adjustment means, which is located in said selected distal one of said pair of support arms, for allowing said second end of said arcuate track to be selectively vertically adjusted along the length of said aperture adjustment means of said distal support arm, thereby providing a variably inclined path way;

(4) a lever arm pivotably mounted to said user support frame, including a handle extending above said user seat and further including a downwardly depending leg carrying a roller at the lowermost end thereof adapted to travel along the length of said arcuate track as said handle is actuated thereby raising and lowering said user's seat upon reciprocating actuating movement of said handle by the user.

13. An exercise machine according to claim 12 wherein said upwardly extending support means comprises a post member.

14. An exercise machine according to claim 12 wherein said user support frame extends generally horizontally and includes a pivotably mounted back support adapted to be used in both a lowered and a raised position.

15. An exercise machine according to claim 12 wherein said user support frame further includes a downwardly depending foot rest platform at the front end thereof.

16. An exercise machine according to claim 12 wherein said aperture adjustment means of said pair of upwardly extending support arms each comprise a plurality of apertures therein along the length thereof.

17. An exercise machine according to claim 16 wherein said plurality of apertures in each of said support arms defines an arc having a radius extending to a corresponding and distal one of said pivot rods.

18. An exercise machine according to claim 12 wherein said pivot rods each comprises a rod extending transversely to a longitudinal axis of said base frame and spaced-apart from its corresponding support arm toward said opposing support arm about 1–3 inches.

19. An exercise machine according to claim 12 wherein said arcuate track includes a pair of notches in the bottom surface adjacent each end thereof for engaging a corresponding one of said pair of pivot rods therein, and said arcuate track further includes an aperture in each end thereof for securement to a corresponding one of said pair of upwardly extending support arms.

20. An exercise machine according to claim 12 wherein said lever arm includes means for adjusting the angle defined between said handle of said lever arm and said downwardly depending roller carrying leg.

* * * * *